United States Patent [19]

Blair et al.

[11] Patent Number: 4,866,955

[45] Date of Patent: Sep. 19, 1989

[54] APPLIANCE CONTROL CIRCUIT

[75] Inventors: Jeffrey L. Blair, Newton; Paul S. Decature, Grinnell; Charles L. Jackson, Newton, all of Iowa

[73] Assignee: Maytag Corporation, Newton, Iowa

[21] Appl. No.: 222,541

[22] Filed: Jul. 21, 1988

[51] Int. Cl.[4] ..... D06F 33/02; D06F 39/14

[52] U.S. Cl. ..... 68/12 R; 200/61.64; 292/DIG. 69

[58] Field of Search ..... 68/12 R; 134/57 DL; 292/DIG. 69; 200/61, 61.62, 61.64, 61.7

[56] References Cited

U.S. PATENT DOCUMENTS 3,627,960 12/1971 Grabeck ..... 200/61.64
4,091,438 5/1978 Olding et al. ..... 361/189
4,232,210 11/1980 Oida et al. ..... 219/10.55 C
4,510,777 4/1985 Ellingson et al. ..... 68/12 R
4,623,179 11/1986 Davis et al. ..... 68/12 R X

FOREIGN PATENT DOCUMENTS 24958 6/1986 Japan ..... 68/12 R

*Primary Examiner*—Philip R. Coe
*Attorney, Agent, or Firm*—Richard L. Ward

[57] ABSTRACT

A microcontroller-based control circuit is provided for an appliance. The appliance includes an access door and an access door actuated switch operated between open and closed postures. The microcontroller monitors the operating condition of the access door actuated switch. If the access door actuated switch has not been cycled between an open and closed posture since the completion of a cycle of operations, a new cycle will not be allowed to start.

7 Claims, 2 Drawing Sheets

APPLIANCE CONTROL CIRCUIT

BACKGROUND OF THE INVENTION

This invention relates generally to the field of appliance control circuits and more particularly to a circuit including a microcontroller operable for monitoring the contact posture of an access door actuated switch. The microcontroller will prevent operation of the appliance if monitoring of the access door actuated switch indicates that the contacts have not been actuated between the open and closed postures during a predetermined period of time.

The prior art relating to appliances has generally required that an access door actuated switch be in the closed posture before the appliance can be operated. Grabeck in U.S. Pat. No. 3,627,960, issued Dec. 14, 1971, teaches the closing of an access door to actuate a switch for conditioning the appliance control circuitry. In this system the switch must be closed to indicate a closed access door prior to operation. There is no teaching of a microcontroller for checking the posture of the switch and for ensuring that the switch contacts are operable between open and closed postures which is an indication of the condition or operability of the switch.

Ellingson et al, in U.S. Pat. No. 4,510,777, issued Apr. 16, 1985 and assigned to the assignee of the instant invention, disclose an appliance controlled by a microcontroller. In this appliance, a first switch is closed when the access door is physically operated to a closed position. Closing the access door positions a latch member for locking the access door in the closed position. A solenoid is then actuated by the microcontroller to lock the access door and close the contacts of a latch switch to provide an access door latched signal to the microcontroller. This latch switch is interrogated by the microcontroller prior to actuating the solenoid for confirming the proper operability of the latch switch. The circuit does not, however, teach the direct interrogation of the access door actuated switch by the microcontroller for determining the proper operability thereof.

It is believed that there has been no teaching of a microcontroller-based appliance control circuit wherein the microcontroller is operable for directly monitoring the contact posture of an access door actuated switch and for preventing operation of the appliance in the event that the switch is not functional.

SUMMARY OF THE INVENTION

It is therefore an object of the instant invention to provide an improved microcontroller-based appliance control circuit.

It is a further object of the instant invention to provide a microcontroller-based appliance control circuit for determining whether an access door actuated switch has been cycled between open and closed postures since the completion of a cycle of operations.

It is a still further object of the instant invention to provide a microcontroller-based appliance control circuit for preventing operation of the appliance until the access door actuated switch is determined to be operable.

Briefly, the instant invention achieves these objects in a control system for controlling an appliance through at least one cycle of operations. A cabinet is associated with the appliance and includes structure having an opening defining an access into the appliance. An access door is mounted on the cabinet and is movable between an access-open and an access-closed position. A control circuit includes a microcontroller for controlling the appliance through the cycle of operations. An access door actuated switch is associated with the circuit and is actuatable between a first posture with the access door in the open position and a second posture with the access door in a closed position. The microcontroller includes circuitry operable for interrogating the access door actuated switch to determine its posture and for storing switch posture information. The microcontroller is further operable for providing the cycle of operations only when the access door actuated switch is in the access-closed second posture and has been previously actuated from the access-closed second posture to the access-open first posture.

Operation of the appliance control circuit and further objects and advantages thereof will become evident as the description proceeds and from an examination of the accompanying two sheets of drawings.

BRIEF DESCRIPTION OF THE DRAWINGS

The drawings illustrate a preferred embodiment of the invention with similar numerals referring to similar parts throughout the several views, wherein.

DESCRIPTION OF A PREFERRED EMBODIMENT

Figure 1:
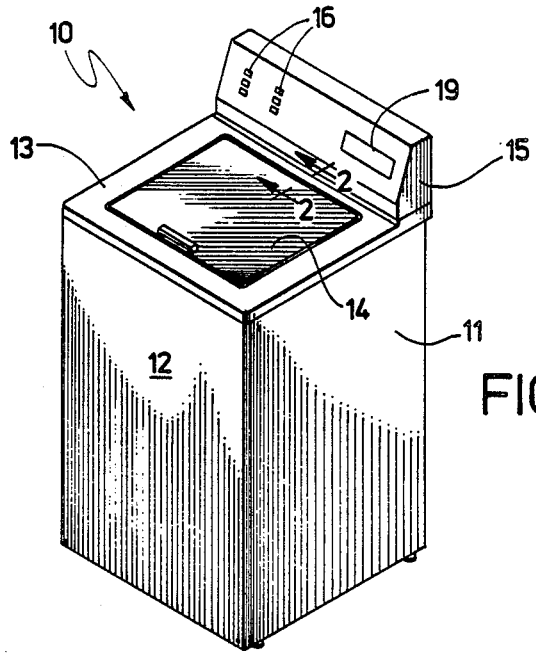
FIG. 1 is an isometric view of an automatic washing machine utilizing the control circuit of the instant invention.
Figure 2:
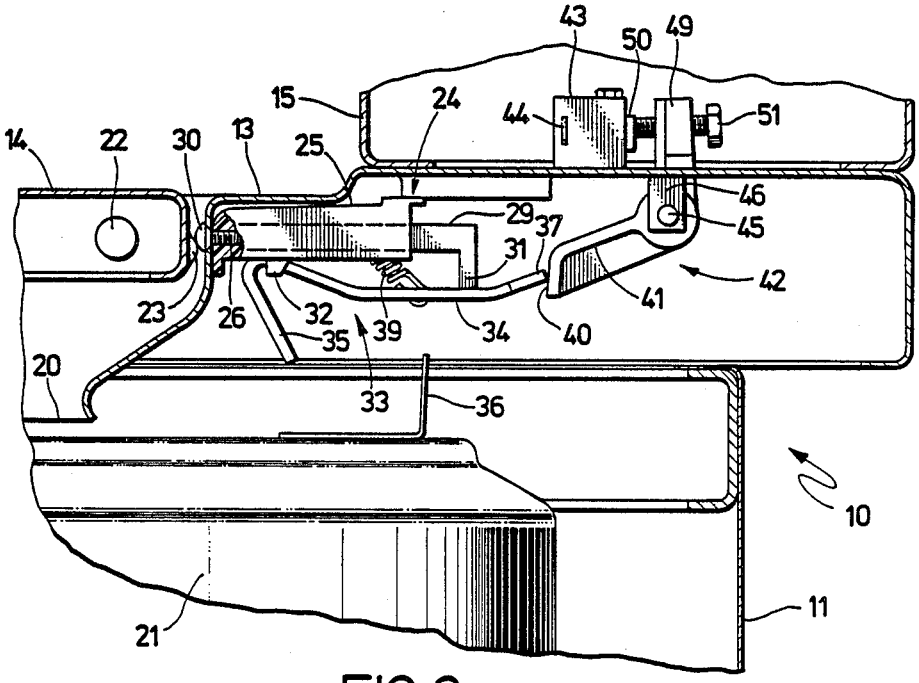
FIG. 2 is a partial fragmentary section view taken generally along lines 2—2 of FIG. 1 and showing the access door actuated switch mounted to the cabinet and actuating linkage therefor.

Referring now to the drawings and to FIGS. 1 and 2 in particular, there is shown an automatic washing machine 10. The automatic washing machine 10 is housed within a generally rectangular cabinet having a three-sided enclosure 11 forming the sides and rear of the cabinet. A vertically oriented front panel 12 completes the peripheral cabinet of the washing machine 10. The cabinet of the washing machine 10 also includes a substantially horizontally disposed top cover 13 having a pivotable access door 14 for providing access to the interior of the washing machine 10. control housing 15 extends generally upward from the rear of the top cover 13 and houses miscellaneous controls such as selection switches 16 and a display 19 for providing cycle information to an operator. As best shown in FIG. 2, the top cover 13 includes an access opening 20 through which fabrics may be inserted into or removed from the tub 21. The access opening 20 is closed by the access door 14 which is pivoted about a fulcrum 22 spaced a short distance from the rear end 23 of the access door 14. The rear end 23 of the access door 14 functions as a lever with respect to the fulcrum 22 for engaging the switch actuating-unbalance mechanism 24.

The switch actuating-unbalance mechanism 24 includes a molded plastic frame 25 which is attached to the top cover 13 as shown in FIG. 2 by a pair of screws 26 which extend through the top cover 13 and thread into the frame 25. A plunger 29 is slidingly supported within the frame 25. The front end of the plunger 29 is in the form of a projecting nose 30 extending generally horizontally through the top cover 13 and in contact with the rear end 23 of the access door 14. The frame 25 is generally hollow and supports the plunger 29 for substantially horizontal movement to the right and/or left depending on the posture of the access door 14. The rear end of the plunger 29 has a downwardly extending flange 31. The plunger 29 also includes an undercarriage 32 for pivotally supporting the unbalance actuator 33 on the plunger 29.

The unbalance actuator 33 is pivotally supported by the plunger undercarriage 32 and includes a horizontally extending portion 34 having an upturned end 37 and engageable with the bottom edge of the rear flange 31 of the plunger 29. The unbalance actuator 33 further includes a depending lever 35 extending substantially downwardly from the pivot connection between the unbalance actuator 33 and the plunger 29. The depending lever 35 is positioned for engagement by the bumper 36 upon excessive gyration of the tub 21.

A biasing spring 39 is disposed between the unbalance mechanism frame 25 and the unbalance actuator 33. This biasing spring 39 provides upwardly and forwardly directed components of biasing force. The upwardly directed component of force maintains the horizontally extending portion 34 of the unbalance actuator 33 against the rear flange 31 of the plunger 29. The forwardly directed component of force biases the unbalance actuator 33 and the plunger 29 in a forward direction to maintain engagement of the plunger nose 30 with the rear end 23 of the access door 14.

An access door actuated switch 43 is attached to the top cover 13 within the control housing 15 as best shown in FIG. 2. The access door actuated switch 43 includes a pair of connector terminals such as indicated at numeral 44 by which the access door actuated switch 43 is connected to the drive motor circuitry and to a microcontroller 53 as will be further discussed herein.

The bell crank shaped switch actuator 42 is pivotally mounted on a pin 45 extending between a pair of downwardly projecting tabs 46 formed in the top cover 13. The first or lower arm 41 of the bell crank shaped actuator 42 includes an actuating face 40 engageable with the upturned end 37 of the unbalance actuator 33. The second arm 49 of the switch actuator 42 is angularly disposed with respect to the first arm 41 and is juxtaposed to the rearwardly facing actuating button 50 of the access door actuated switch 43. The second arm 49 includes a threaded member 51 which provides for fine adjustment between the switch actuating-unbalance mechanism 24 and the actuating button 50.

The switch actuating-unbalance mechanism 24 in cooperation with the access door 14 causes the plunger 29 to bias the actuating button 50 of the access door actuated switch 43 to the left through the switch actuator 42 when the access door 14 is closed as shown in FIG. 2. In this position, the contacts of the access door actuated switch 43 are closed.

Figure 3:
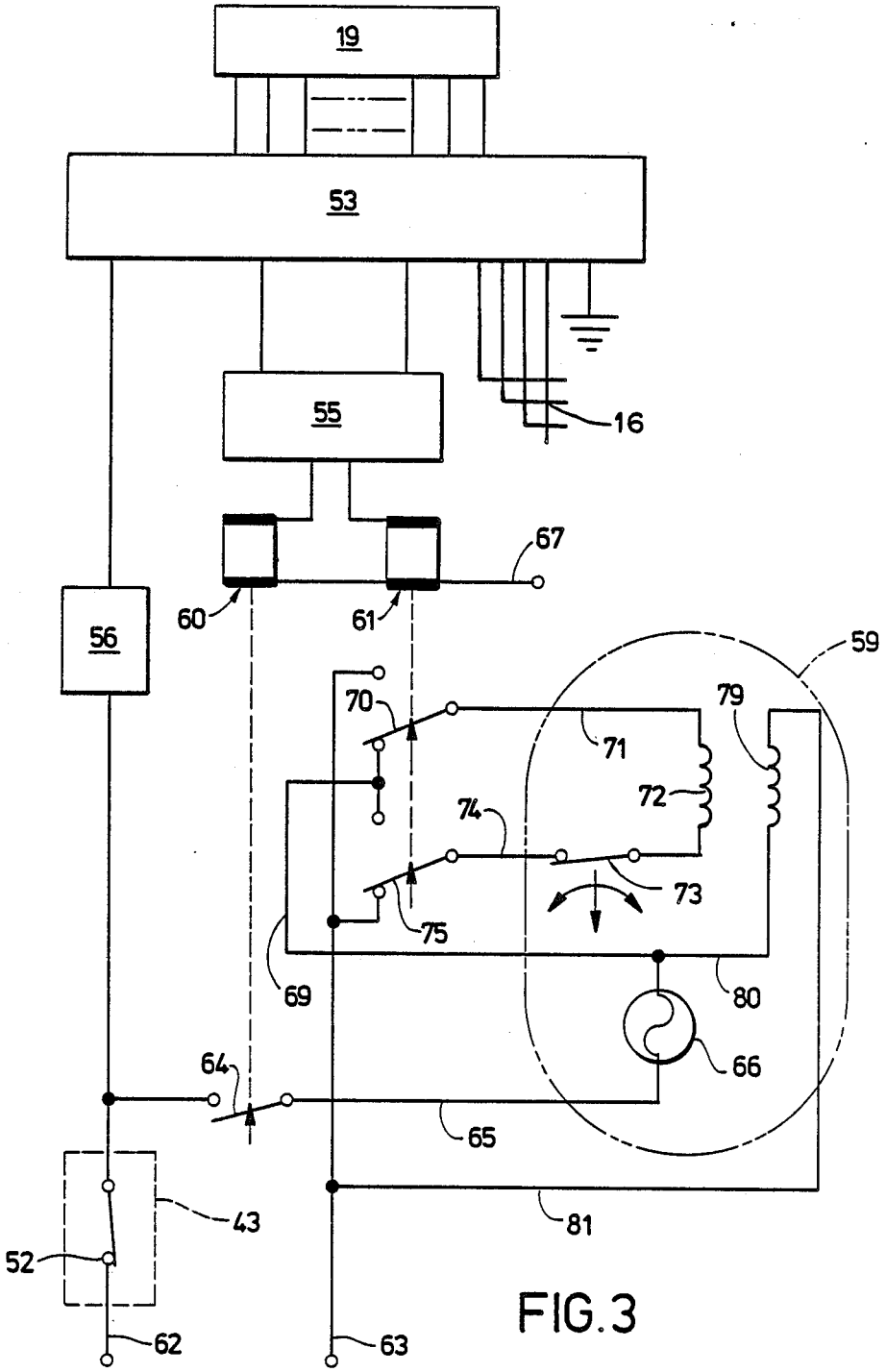
FIG. 3 is an electrical schematic drawing of the operational circuitry of the instant invention.

Turning now to FIG. 3, there is shown a partial electrical schematic circuit for the automatic washing machine 10. The circuit includes a microcontroller such as an NEC UPD7519 designated generally by the rectangle 53. The circuit also includes an LED or vacuum fluorescent display indicated 19, a Sprague ULN 2005A relay interface identified by rectangle 55, a General Instrument MCT66 optoisolator designated by the rectangle 56, the access door actuated switch 43, a drive motor 59, a low voltage run relay 60 and a low voltage spin or directional relay 61.

The drive motor 59 is powered by standard 120 VAC household power supplied between conductors 62 and 63. A transformer and rectifier circuit (not shown) provides 24 VDC to power the low voltage relays 60 and 61 at conductor 67.

A cycle of operations for the automatic washing machine 10 is initiated by pressing a cycle selection switch 16 associated with the control housing 15 and shown in FIG. 1. In normal operation, before choosing a cycle selection switch 16, the access door 14 is closed by pivoting it about the fulcrum 22 to engage the rear end 23 of the access door 14 with the nose 30 of the plunger 29 and close the contacts 52 of the access door actuated switch 43.

The microcontroller 53 is operable for monitoring the posture of the contacts 52 of the access door actuated switch 43 through the optoisolator 56. It is desirable for the automatic washing machine 10 to progress through a chosen cycle of operations with the access door 14 in the closed position. Therefore, the access door actuated switch 43 is arranged so that it is in a posture for providing power to the drive motor 59 only when the access door 14 is closed. It is, however, remotely possible that the contacts 52 of the access door actuated switch 43 could be welded closed or otherwise failed in the closed posture so that the automatic washing machine 10 could operate with the access door 14 open.

In order to negate this possibility, the microcontroller 53 monitors the posture of the contacts 52 of the access door actuated switch 43 during predetermined portions of a cycle to ensure that the access door actuated switch 43 is properly operable. Although the microcontroller continually monitors or checks the posture of the contacts 52 of the access door actuated switch 43, an appropriate time for determining the posture of contacts 52 is just prior to the beginning of a new cycle of operations. Normally, at the end of a cycle of operations, the operator will open the access door 14 to remove articles of clothing from the tub 21. This normal operation will open the contacts 52 of the access door actuated switch 43.

It is noted that the microcontroller 53 is constantly in a powered up state whenever the automatic washing machine 10 is plugged into household power. The circuit normally includes back-up circuitry for maintaining power to the microcontroller 53 even if the automatic washing machine 10 should be temporarily without line power.

The microcontroller 53 has several subroutines within its program of operations. Included is a subroutine wherein the posture of the contacts 52 of the access door actuated switch 43 are monitored on a continuing basis of approximately once each millisecond. A value representing the posture of the contacts 52 is stored in the memory of the microcontroller 53. The microcontroller 53 will determine if the contacts 52 of the access door actuated switch 43 have been opened since the end of a completed cycle of operations. If, after a cycle has been completed, the microcontroller 53 finds that the contacts 52 have not been opened, it will prevent any operation of the automatic washing machine 10 by rendering the selection switches 16 inoperable until the contacts 52 of the access door actuated switch 43 have been opened. The microcontroller 53 will also effect the display of a code indicating a failure to detect operability of the access door actuated switch 43. If the microcontroller 53 finds that the contacts 52 of the access door actuated switch 43 have not been opened since the end of a cycle, it is possible that the automatic washing machine 10 has simply not been opened to unload the washed clothing. In this case, opening the access door 14 will cycle the contacts 52 of the access door actuated switch 43 and the automatic washing machine 10 will be ready to operate. However, if after opening the access door 14, a code indicating a non-operable access door actuated switch 43 still is displayed, it is likely that the access door actuated switch 43 has failed. In this case, the microcontroller 53 will not permit a cycle of operations to begin until corrective action, such as replacing the access door actuated switch 43, has been taken.

It is anticipated that the microcontroller 53 could be instructed to allow a cycle of operations to progress up to the point where the drive motor 59 would be energized. At that point, individual components of the automatic washing machine 10 could be deenergized and a code could be displayed if the contacts 52 of the access door actuated switch 43 have not been confirmed operable. It is further possible to permit operation of the automatic washing machine 10 through one or more cycles in a predetermined time period even though the contacts 52 have not been confirmed operable. In the preferred embodiment of the invention, the determination of the posture of the contacts 52 prior to the start of a new cycle of operations avoids situations which might occur during the actual cycle such as interruption with a full tub of water.

Referring again to FIGS. 1–3 and in particular FIG. 3, when the contacts 52 of the access door actuated switch 43 have been checked and verified as having been opened and closed since the end of the last cycle of operations, the microcontroller 53 will initiate the energization of the run and/or directional relays 60 and/or 61 depending on the cycle selected. If, for example, a cycle requiring agitation is selected, the microcontroller 53 will first energize a tub fill circuit (not shown) to fill the tub 21 to the proper water level for washing clothes. Once the fill operation has been completed, the run relay 60 will be energized to complete a circuit from conductor 62, through the closed contacts 52 of the access door actuated switch 43, through the now closed switch arm 64 of the run relay 60, through conductor 65, thermoprotector 66, conductor 69, first directional relay switch arm 70, conductor 71, start winding 72, centrifugal switch 73, conductor 74, second directional relay switch arm 75, and conductor 63. Once the drive motor 59 reaches run speed, the centrifugal switch 73 will open and the start winding 72 will drop out of the circuit. The run winding 79 will remain energized by way of conductors 80 and 81 to conductor 63.

If a cycle selection calls for spin or rotation of the drive motor 59 in the reverse direction, the microcontroller 53 will first energize the directional relay 61 to move the first and second relay switch arms 70 and 75 in the direction of the arrow to a second contact posture. The run relay 60 will then be energized to complete the run circuit for the drive motor 59 but in an opposite direction of rotation from agitate since the start winding 72 will be energized in the reverse direction.

There has thus been provided by the instant invention an improved appliance control circuit. In this improved control circuit a microcontroller is utilized for controlling the appliance through a cycle of operations. The microcontroller is operable for monitoring the posture of contacts associated with an access door actuated switch for ensuring that the access door actuated switch is properly operable and for preventing the start of any cycle if not properly operable.

In the drawings and specification, there has been set forth a preferred embodiment of the invention and although specific terms are employed, these are used in a generic and descriptive sense only and not for purposes of limitation. Changes in the form and the proportion of parts as well as the substitution of equivalents are contemplated as circumstances may suggest or render expedient without departing from the spirit or scope of the invention and further defined in the following claims.

We claim:

1. A control system for controlling an appliance through at least one cycle of operations, said appliance including a cabinet having an opening defining an access into said appliance and an access door movable between an access-open and an acesss-closed position, the improvement comprising: circuit means including a low voltage circuit portion having micro-controller based program means for controlling said appliance through said cycle of operations, a high voltage circuit portion having an access door actuated line switch actuatable between a first posture with said access door in said access-open position for interrupting operation of said appliance and a second posture with said access door in said access-closed position for permitting operation of said appliance, circuit isolating interface means between said program means and said access door actuated line switch, and means operably associated with said program means for interrogating said access door actuated line switch through said circuit isolating interface means to determine the posture of said access door actuated line switch and for storing line switch posture information, said program means being operable for initiating said cycle of operations only when said access door sctyated line switch is in said access-closed second posture and has been previously actuated from said access-closed second posture to said access-open first posture.

2. A control system as defined in claim 1 wherein said access door actuated line switch is interrogated to verify proper operation thereof during at least one predetermined time in said cycle of operation.

3. A control system as defined in claim 1 wherein said circuit means further includes cycle selection means directly operable for initiating said cycle of operations when said access door actuated line switch has been determined properly operable.

4. A control system as defined in claim 3 wherein said program means is further operable for disabling said cycle selection means until said access door actuated line switch has been confirmed operable.

5. A control system for controlling an appliance through at least one cycle of operations, said appliance including a cabinet with an opening defining an access and an access door mounted on said cabinet and moveable between an access-open and an access-closed position, wherein the improvement comprises: circuit means including a low voltage circuit portion having microcontroller-based program means for controlling said appliance through said cycle of operations, a high voltage circuit portion having an access door actuated line switch actuatable between a first posture with said access door in said access-open position for deenergizing said high voltage circuit portion and interrupting operation of said appliance and a second posture with said access door in said access-closed position for energizing said high voltage circuit portion and permitting operation of said appliance, circuit isolating interface means between said program means and said access door actuated line switch, interrogation means operably associated with said program means for interrogating said access door actuated line switch through said circuit isolating interface means and for receiving a signal confirming the actuation of said access door actuated line switch to said access-open first posture, and cycle selection means manually operable for initiating said cycle of operations when said access door actuated line switch has been actuated to said access-closed second posture, said interrogation means being operable for monitoring the posture of said access door actuated line switch throughout at least predetermined portions of said cycle of operations with said program means operable for disabling said cycle selection means to prevent operation of said appliance when said access door actuated line switch has not been previously actuated from said access-closed second posture to said access-open first posture.

6. A control system as defined in claim 5 wherein said circuit means further includes a low voltage display means and said program means is operable for effecting the display of a code therein responsive to interruption of said high voltage circuit portion to said appliance.

7. A control system for controlling an appliance through at least one cycle of operations, said appliance including a cabinet having an opening defining an access into said appliance and an access door movable between an access-open and an access-closed position, the improvement comprising: circuit means including a low voltage circuit portion having micro-controller-based program means for controlling said appliance through said cycle of operations, a high voltage circuit portion having an access door actuated line switch actuatable between a first posture for interrupting energization of said appliance with said access door in said access-open position and a second posture for energizing said appliance with said access door in said access-closed position, circuit isolating interface means between said program means and said access door actuated line switch, and interrogation means operably associated with said program means for interrogating said access door actuated line switch. through said circuit isolating interface means to verify actuation to said first posture at a predetermined point in time associated with said cycle of operations, said program means being operable for initiating said cycle of operations only when said access door actuated line switch is in said access-closed second posture and has been previously actuated from said access-closed second posture to said access-open first posture and back to said access-closed second posture whereby failure of said access door actuated line switch to actuate to said access-open first posture upon movement of said access door to said access-open position will prevent operation of said appliance.

* * * * *